US007384168B2

(12) United States Patent
Whitlow et al.

(10) Patent No.: US 7,384,168 B2
(45) Date of Patent: Jun. 10, 2008

(54) LIGHT FIXTURE HAVING AIR DUCTS

(75) Inventors: Dana L. Whitlow, Veradale, WA (US); Martin C. Werr, Spokane, WA (US); Farshad Arfaa, Danville, CA (US)

(73) Assignees: Hubbell Incorporated, Orange, CT (US); SBC Knowledge Ventures, L.P., Reno, NV (US)

( * ) Notice: Subject to any disclaimer, the term of this patent is extended or adjusted under 35 U.S.C. 154(b) by 0 days.

(21) Appl. No.: 10/980,862

(22) Filed: Nov. 4, 2004

(65) Prior Publication Data

US 2005/0122725 A1 Jun. 9, 2005

Related U.S. Application Data

(63) Continuation of application No. 10/446,167, filed on May 28, 2003, now abandoned.

(51) Int. Cl.
*F24F 13/078* (2006.01)
*F21S 8/04* (2006.01)

(52) U.S. Cl. ..... 362/149; 362/96; 362/218; 454/294

(58) Field of Classification Search ..... 362/373, 362/346, 347, 349, 374, 294, 260, 345, 364, 362/149, 218, 96; 165/48.1; 454/294, 293
See application file for complete search history.

(56) References Cited

U.S. PATENT DOCUMENTS 2,564,334 A * 8/1951 Kennedy ..... 454/293
2,577,771 A * 12/1951 Kennedy ..... 362/218
2,960,602 A * 11/1960 Kurth et al. ..... 362/218
2,991,708 A * 7/1961 Falk et al. ..... 454/293
3,045,577 A * 7/1962 Lazerson ..... 454/293
3,101,038 A * 8/1963 Archer ..... 362/96
3,103,156 A * 9/1963 Quin ..... 362/218
3,103,157 A 9/1963 Quin
3,108,529 A 10/1963 Sweetser
3,173,616 A * 3/1965 Lipscomb ..... 362/218
3,181,450 A 5/1965 Kruger
3,187,660 A * 6/1965 Lazerson ..... 454/293
3,220,332 A * 11/1965 Straub ..... 454/293
3,246,137 A * 4/1966 Zagel ..... 362/218
3,348,465 A * 10/1967 Kruger ..... 454/293
3,419,714 A * 12/1968 Slauer ..... 362/218
3,420,439 A 1/1969 Meckler
3,424,233 A * 1/1969 Gershon ..... 165/48.1

(Continued)

*Primary Examiner*—Ismael Negron
(74) *Attorney, Agent, or Firm*—Marcus R. Mickney; Mark S. Bicks; Alfred N. Goodman

(57) ABSTRACT

A light fixture has an outer housing having a top outer wall, outer side walls extending substantially perpendicularly from the outer edges of the top outer wall, an inner housing having a top inner wall, and inner side walls extending substantially perpendicularly from the inner edges of the top inner wall. A lamp receiving socket is attached to the inner housing. The outer housing includes an opening adapted to connect to a ventilation system. First and second channels are defined between the top outer wall and the first outer and inner side walls, and the top outer wall and the second outer and inner side walls, respectively. Each of the first and second channels have a width that is approximately ⅙ the distance between the first and second outer side walls.

34 Claims, 4 Drawing Sheets

U.S. PATENT DOCUMENTS 3,693,530 A * 9/1972 Larkfeldt et al. ..... 454/294
3,945,306 A 3/1976 Brown
4,449,166 A * 5/1984 Sharp ..... 362/149

* cited by examiner

LIGHT FIXTURE HAVING AIR DUCTS

REFERENCE TO PRIOR NONPROVISIONAL APPLICATION

This application is a continuation application of U.S. patent application Ser. No. 10/446,167, filed May 28, 2003 now abandoned, which is hereby incorporated by reference in its entirety.

FIELD OF THE INVENTION

The present invention relates to a light fixture having air ducts. More particularly, the present invention relates to a light fixture having air ducts that extend along the entire length and height of the light fixture to provide increased air flow. Additional light fixtures may be connected in which the air ducts are in fluid communication throughout the light fixture assembly.

BACKGROUND OF THE INVENTION

Light fixtures exist that have ducts or channels to supply air to a space from a ventilation system, such as a room in a building. These existing light fixtures have elongated channels running substantially along the length of the light fixture. However, the width of those channels is relatively narrow with regard to the overall width of the light fixture. Thus, the amount of air deliverable to the room in which the light fixture is installed is unduly limited, thereby also decreasing the efficiency of the light fixture to supply air to the room. Therefore, a need exists for a light fixture that delivers a greater volumetric rate of air with greater efficiency.

Existing light fixtures having air ducts are disclosed in U.S. Pat. No. 2,991,708 to Falk; U.S. Pat. No. 3,045,577 to Lazerson; U.S. Pat. No. 3,108,529 to Sweetser; U.S. Pat. No. 3,181,450 to Kruger; U.S. Pat. No. 3,220,332 to Straub; and U.S. Pat. No. 3,424,233 to Meckler. For example, as shown in FIG. 5 of the Falk patent, the outlet slots 45 are relatively narrow compared to the overall width of the flange 12 of the lighting apparatus 10. Thus, the amount of air deliverable to the room is restricted by the narrowness of the outlet apertures. A need exists for a light fixture having wider channels to deliver a greater volume of air to a room.

Thus, there is a continuing need to provide improved light fixtures having air ducts.

SUMMARY OF THE INVENTION

Accordingly, it is a primary objective of the present invention to provide an improved light fixture having an air duct.

A further objective of the present invention is to provide a light fixture having more efficient air ducts.

A still further objective of the present invention is to provide a light fixture that provides increased air flow through its air ducts.

A still further objective of the present invention is to provide a light fixture having wider channels to deliver a greater volume of air to a room in which the light fixture is installed.

The foregoing objects are basically attained by providing a light fixture. An outer housing of the light fixture has a top outer wall having first and second outer edges. First and second outer side walls extend substantially perpendicularly from the first and second outer edges. An inner housing is disposed substantially within the outer housing and has a top inner wall that has first and second inner edges. First and second inner side walls extend substantially perpendicularly from the first and second inner edges. A lamp receiving socket is attached to the inner housing. An opening in the outer housing is adapted to connect to a ventilation system. A first channel is defined between the top outer wall, the first outer side wall and the first inner side wall to receive air from the ventilation system through the opening. A second channel is defined between the top outer wall, the second outer side wall and the second inner side wall to receive air from the ventilation system through the opening. The first and second channels have a combined width that is approximately ⅓ the distance between the first and second outer side walls.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

Referring now to the drawings that form a part of the original disclosure.

DETAILED DESCRIPTION OF THE INVENTION

Figure 1:
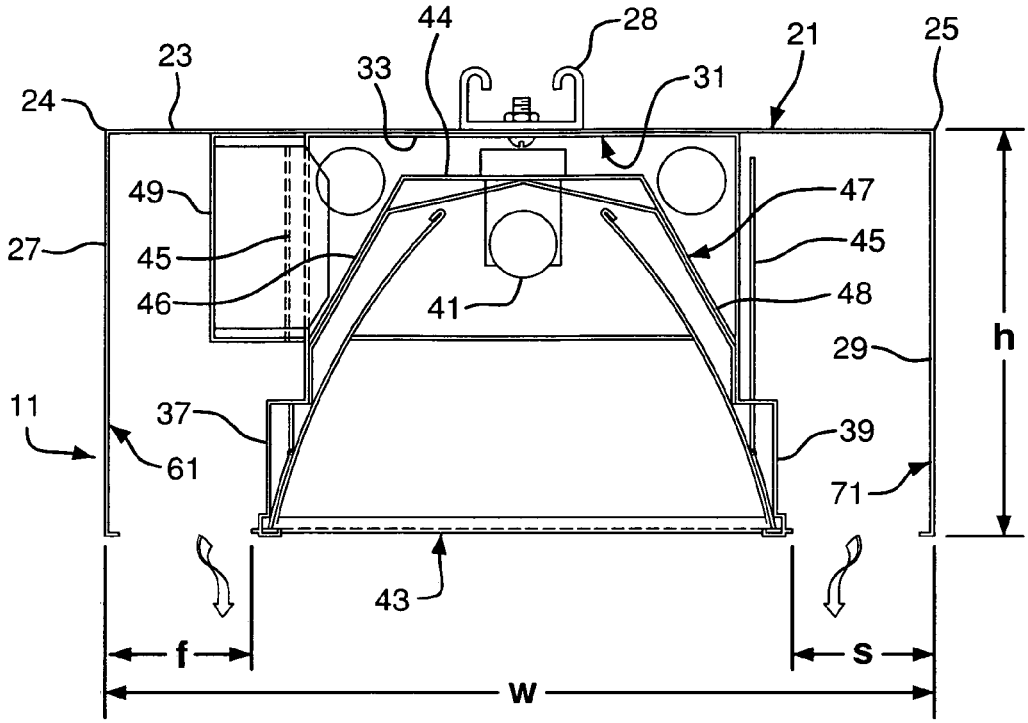
FIG. 1 is an front elevation view in cross-section of the light fixture of the present invention.
Figure 2:
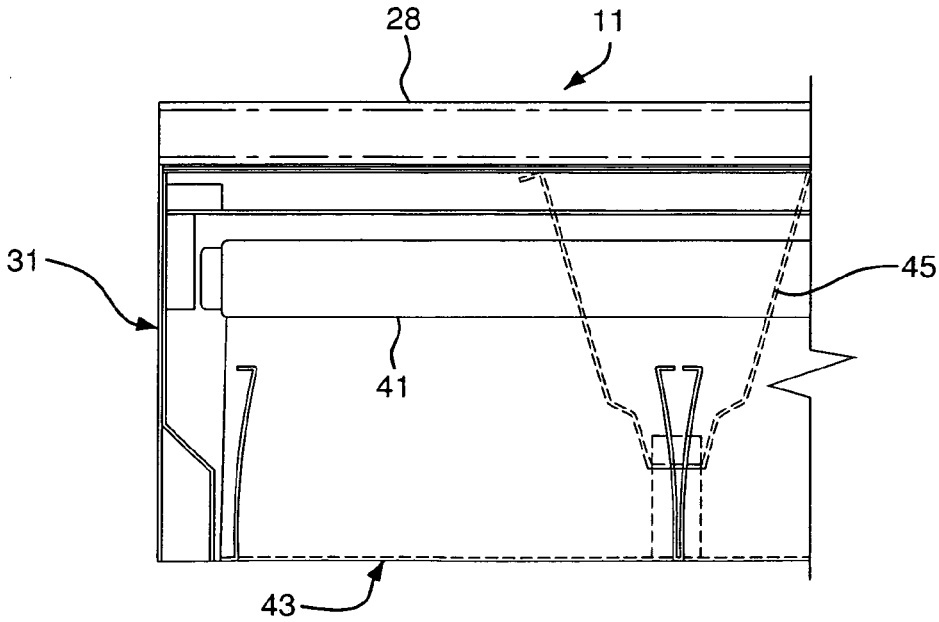
FIG. 2 is a side elevation view of the light fixture of FIG. 1.

As seen in FIGS. 1-7, the light fixture 11 in accordance with the present invention includes an inner housing 31 substantially disposed within an outer housing 21. Lamp receiving sockets 93 and 95 are attached to the inner housing 31. An opening 51 in the outer housing 21 is adapted to be connected to a ventilation system. Channels 61 and 71 extend along the length of the light fixture 11 to deliver air from the ventilation system, through the light fixture and into the space in which the light fixture is installed.

Figure 3:
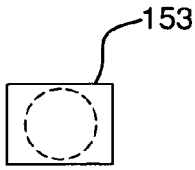
FIG. 3 is a top view of an air box cover.
Figure 4:
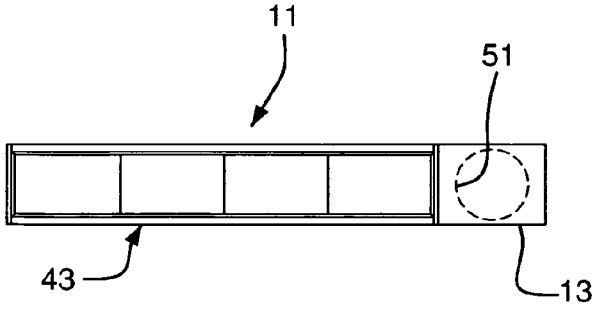
FIG. 4 is a top view of a light fixture having one inlet.
Figure 7:
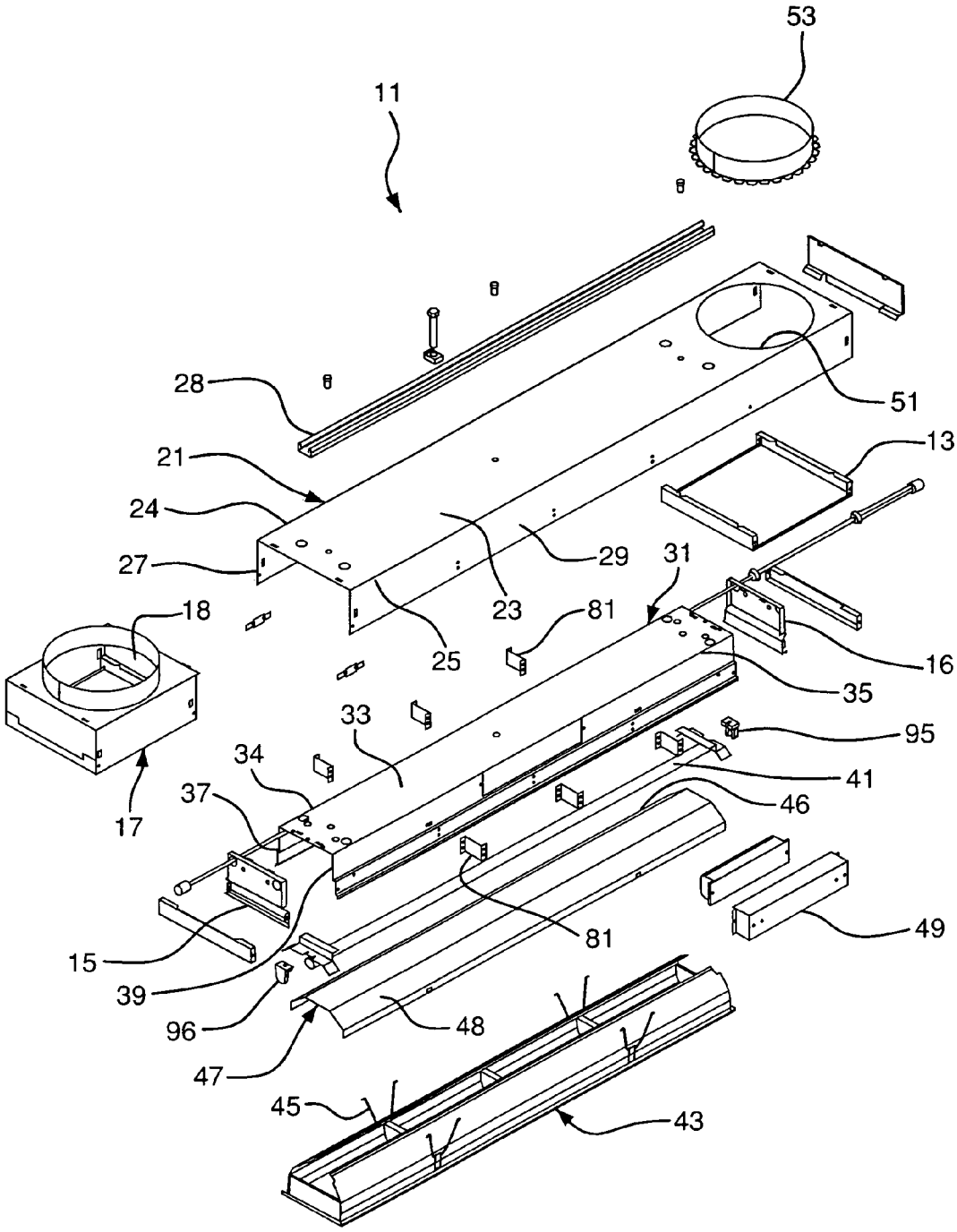
FIG. 7 is an exploded view of the light fixture of the present invention.

The outer housing 21 of the light fixture 11 has a top outer wall 23 having a first outer edge 24 and a second outer edge 25, as shown in FIGS. 1 and 7. A first outer side wall 27 extends substantially perpendicularly from the first outer edge 24. A second outer side wall 29 extends substantially perpendicularly from the second outer edge 25. As shown in FIG. 7, the outer housing 21 is substantially U-shaped. An opening 51 in the top outer wall 23 of the outer housing 21 is adapted to be connected to a ventilation system (not shown). As shown in FIG. 7, an air duct 53 may be inserted in opening 51 to facilitate connection of the light fixture 11 to the ventilation system. As shown in FIG. 3, a cover 153 may be inserted into opening 51 to prevent foreign debris from entering the opening when not in use.

Figure 6:
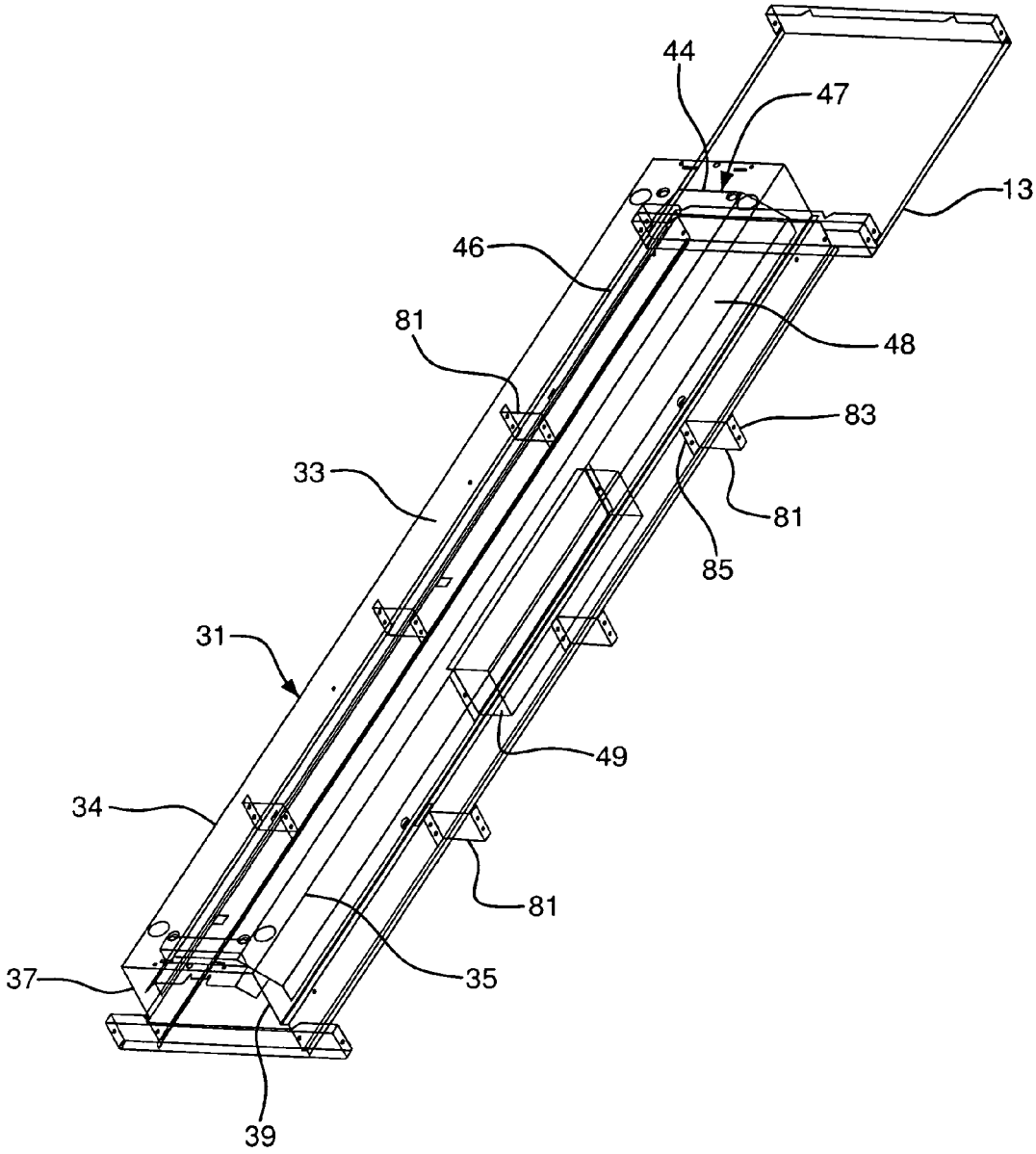
FIG. 6 is a perspective view of the light fixture of the present invention without the outer housing connected to the inner housing.

The inner housing 31 is disposed substantially within the outer housing 21, as shown in FIGS. 1 and 7. The inner housing 31 has a top inner wall 33 that has a first inner edge 34 and a second inner edge 35, as shown in FIG. 6. A first inner side wall 37 extends substantially perpendicularly from the first inner edge 34. A second inner side wall 39 extends substantially perpendicularly from the second inner side edge 35. Preferably, the top inner wall 33 of the inner housing 31 is directly connected to the top outer wall 23 of the outer housing 21, as shown in FIG. 1.

Tray 13 is connected to an end of the inner housing, as shown in FIGS. 4-7. End caps 15 and 16 cover opposite ends of the inner housing, thereby preventing supplied air from entering the inner housing 31 and adversely effecting operation of the lamp, or light, 41. The lamp is received by the lamp receiving sockets 93 and 95 that are connected to the inner housing 31. Preferably, the lamp 41 is a fluorescent lamp. An air box 17, as shown in FIG. 7, may be positioned on the tray to facilitate direction of the air to the channels 61 and 71. Opposing slots 18 in the air box 17 direct supplied air to the sides of the light fixture 11.

A connector 28 is attached to the top outer wall 23 of the outer housing 21, as shown in FIGS. 1 and 7. Preferably, the connector 28 is a unistrut. The connector 28 is adapted to be connected to a mating connector (not shown). The mating connector may be, but is not limited to, a unistrut or angle iron mounted on a support, such as a ceiling. Attaching the connector 28 to the mating connector securely fixes the light fixture 11 to a support.

A louver assembly 43 is attached to the inner housing 31, as shown in FIGS. 1 and 7. Torsion springs 45 allow the louver assembly to snap fit with the inner housing 31 and reflector 47. Reflector 47 is connected to the inner housing 31. Reflector walls 46 and 48 taper downwardly and outwardly from reflector upper surface 44. Ballast box 49 is mounted to an inner side wall of the inner housing 31, as shown in FIGS. 1 and 7.

The first channel 61 is defined between the top outer wall 23, the first outer side wall 27 and the first inner side wall 37, as shown in FIG. 1. Air from the ventilation system is supplied through the opening 51 in the outer housing 21 and into the first channel 61. There is no bottom wall in the first channel 61, so that air is supplied into the space in which the light fixture 11 is installed. Preferably, the width "f" of the first channel 61 is approximately ⅙ of the light fixture width "w". First channel 61 has a height of "h", as shown in FIG. 1, which is substantially the height of the first and second inner and outer side walls.

The second channel 71 is defined between the top outer wall 23, the second outer side wall 29 and the second inner side wall 39, as shown in FIG. 1. Air from the ventilation system is supplied through the opening 51 in the outer housing 21 and into the second channel 71. There is no bottom wall in the second channel 71, so that air is supplied into the space in which the light fixture 11 is installed. Preferably, the width "s" of the second channel 71 is approximately ⅙ of the light fixture width "w". Preferably, the first and second channels have a combined width ("f"+ "s") that is approximately ⅓ the distance between the first and second outer side walls (width "w"). Second channel 71 has a height of "h", as shown in FIG. 1, which is substantially the height of the first and second inner and outer side walls. By providing wide air channels, a greater volume of air is able to be more efficiently supplied to the room in which the light fixture 11 is installed.

Supports 81 are mounted in the first and second channels 61 and 71 to provide rigidity to the structure, thereby eliminating vibration that may be caused by the air flow through the channels, as shown in FIGS. 6 and 7. The supports are preferably Z-shaped, thereby having opposing flat surfaces 83 and 85 for mounting on the inner and outer side walls. The supports 81 also facilitate directing the supplied air downwardly through the channels, out the open bottoms and into the room, as shown by the directional arrows in FIG. 1.

Figure 5:
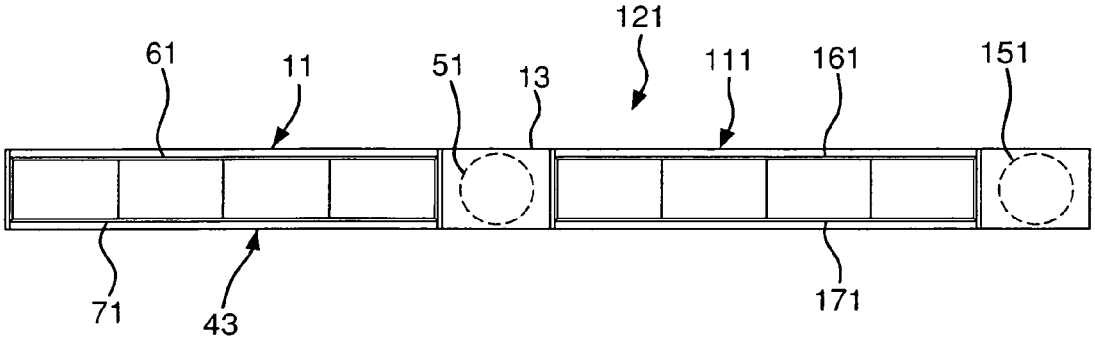
FIG. 5 is a top view of a light fixture having two inlets.

As shown in FIG. 5, multiple light fixtures 11 and 111 may be connected together as desired to produce a larger light fixture assembly 121. Each light fixture may be connected to the ventilation system through openings 51 and 151 in the outer housings. A cover 153 (FIG. 3) maybe inserted in an opening if it is not to be connected to the ventilation system, thereby preventing foreign debris from entering the inner housing of the light fixtures. Since end caps 15 and 16 only prevent supplied air from entering the inner housings of the light fixtures, the first channels 61 and 161 and the second channels 71 and 171 are all in fluid communication along the entire length of the light fixture assembly 121. This modular assembly enables an even distribution of air flow along the entire length of the light fixture assembly 121.

While advantageous embodiments have been chosen to illustrate the invention, it will be understood by those skilled in the art that various changes and modifications may be made therein without departing from the scope of the invention as defined in the appended claims.

What is claimed is:

1. A light fixture, comprising:

an outer housing having a top outer wall having first and second outer edges, first and second outer side walls extending substantially perpendicularly from said first and second outer edges;

an inner housing disposed substantially within said outer housing and having a top inner wall having first and second inner edges, first and second inner side walls extending substantially perpendicularly from said first and second inner edges, said top inner wall of said inner housing is directly connected to said top outer wall of said outer housing;

a lamp receiving socket attached to said inner housing;

an opening in said outer housing connectable to a ventilation system; and a first channel defined between said top outer wall, said first outer side wall and said first inner side wall receiving air from the ventilation system through said opening such that air received from the ventilation system does not flow through the inner housing, said first channel having a width that is approximately ⅙ the distance between said first and second outer side walls.

2. A light fixture according to claim 1, wherein a cover is positioned over said opening.

3. A light fixture according to claim 1, wherein said opening is in said top outer wall.

4. A light fixture according to claim 1, wherein said inner and outer housings are made of metal.

5. A light fixture according to claim 1, wherein a reflector is connected to said inner housing.

6. A light fixture according to claim 1, wherein the air is conveyed through said first channel without a fan being disposed in said light fixture.

7. A light fixture according to claim 1, wherein a plurality of supports are connected between said first inner and outer side walls and between said second inner and outer side walls.

8. A light fixture according to claim 7, wherein said supports are substantially Z-shaped.

9. A light fixture according to claim 1, wherein a second channel is defined between said top outer wall, said second outer side wall and said second inner side wall receiving air from the ventilation system through said opening, said second channel having a width that is approximately ⅙ the distance between said first and second outer side walls.

10. A light fixture according to claim 9, wherein said first and second channel have a combined width that is approximately ⅓ the distance between said first and second outer side walls.

11. A light fixture according to claim 9, wherein a second light fixture substantially identical to said light fixture is connected to said light fixture, said first and second channels of each light fixture being in fluid communication.

12. A light fixture according to claim 9, wherein an end cap is disposed at each end of said light fixture to entirely cover ends of said inner housing, wherein said end caps do not cover said first and second channels.

13. A light fixture, comprising:

an outer housing having a top outer wall having first and second outer edges, first and second outer side walls extending substantially perpendicularly from said first and second outer edges;

an inner housing disposed substantially within said outer housing and having a top inner wall having first and second inner edges, first and second inner side walls extending substantially perpendicularly from said first and second inner edges, said top inner wall of said inner housing is directly connected to said top outer wall of said outer housing;

a lamp receiving socket attached to said inner housing;

an opening in said outer housing connectable to a ventilation system;

a first channel defined between said top outer wall, said first outer side wall and said first inner side wall receiving air from the ventilation system through said opening;

a second channel defined between said top outer wall, said second outer side wall and said second inner side wall receiving air from the ventilation system through said opening;

said first and second channels having a combined width that is approximately ⅓ the distance between said first and second outer side walls; and a plurality of supports connected between said first inner and outer side walls and between said second inner and outer side walls, wherein said channels convey air received from the ventilation system such that the air does not flow through the inner housing.

14. A light fixture according to claim 13, wherein said supports are substantially Z-shaped.

15. A light fixture according to claim 13, wherein a cover is positioned over said outer housing opening.

16. A light fixture according to claim 13, wherein said opening is in said top outer wall.

17. A light fixture according to claim 13, wherein a second light fixture substantially identical to said light fixture is connected to said light fixture, said first and second channels of each light fixture being in fluid communication.

18. A light fixture according to claim 13, wherein a reflector is connected to said inner housing.

19. A light fixture according to claim 13, wherein an end cap is disposed at each end of said light fixture to entirely cover ends of said inner housing, wherein said end caps do not cover said first and second channels.

20. A light fixture, comprising:

an outer housing having a top outer wall having first and second outer edges, first and second outer side walls extending substantially perpendicularly from said first and second outer edges;

an inner housing disposed substantially within said outer housing and having a top inner wall having first and second inner edges, first and second inner side walls extending substantially perpendicularly from said first and second inner edges, said top inner wall being directly connected to said top outer wall;

a lamp receiving socket attached to said inner housing;

an opening in said top outer wall of said outer housing connectable to a ventilation system;

a first channel defined between said top outer wall, said first outer side wall and said first inner side wall receiving air from the ventilation system through said opening;

a second channel defined between said top outer wall, said second outer side wall and said second inner side wall receiving air from the ventilation system through said opening;

said first and second channels having a combined width that is approximately ⅓ the distance between said first and second outer side walls; and a plurality of supports connected between said first inner and outer side walls and between said second inner and outer side walls, wherein said channels convey air received from the ventilation system such that the air does not flow through the inner housing.

21. A light fixture according to claim 20, wherein said supports are substantially Z-shaped.

22. A light fixture according to claim 20, wherein a cover is positioned over said outer housing opening.

23. A light fixture according to claim 20, wherein a second light fixture substantially identical to said light fixture is connected to said light fixture, said first and second channels of each light fixture being in fluid communication.

24. A light fixture according to claim 20, wherein said inner and outer housings are made of metal.

25. A light fixture according to claim 20, wherein a reflector is connected to said inner housing.

26. A light fixture according to claim 20, wherein an end cap is disposed at each end of said light fixture to entirely cover ends of said inner housing, wherein said end caps do not cover said first and second channels.

27. A light fixture, comprising:

an outer housing having a top outer wall having first and second outer edges, first and second outer side walls extending substantially perpendicularly from said first and second outer edges;

an inner housing disposed substantially within said outer housing and having a top inner wall having first and second inner edges, first and second inner side walls extending substantially perpendicularly from said first and second inner edges, said top inner wall of said inner housing is directly connected to said top outer wall of said outer housing;

a lamp receiving socket attached to said inner housing;

an opening in said outer housing connectable to a ventilation system;

a first channel defined between said top outer wall, said first outer side wall and said first inner side wall receiving air from the ventilation system through said opening;

a second channel defined between said top outer wall, said second outer side wall and said second inner side wall receiving air from the ventilation system through said opening;

said first inner and outer walls and said second inner and outer walls are substantially parallel; and a reflector connected to said inner housing, said reflector having downwardly and outwardly tapering reflector walls, wherein said channels convey air received from the ventilation system such that the air does not flow through the inner housing.

28. A light fixture according to claim 27, wherein said first and second channels have a combined width that is approximately ⅓ the distance between said first and second outer side walls.

29. A light fixture according to claim 27, wherein a cover is positioned over said opening.

30. A light fixture according to claim 27, wherein said opening is in said top outer wall.

31. A light fixture according to claim 27, wherein a second light fixture substantially identical to said light fixture is connected to said light fixture, said first and second channels of each light fixture being in fluid communication.

32. A light fixture according to claim 27, wherein said inner and outer housings are made of metal.

33. A light fixture according to claim 27, wherein a plurality of supports are connected between said first inner and outer side walls and between said second inner and outer side walls.

34. A light fixture according to claim 33, wherein said supports are substantially Z-shaped.

* * * * *